US008338681B2

(12) United States Patent
Mollick

(10) Patent No.: US 8,338,681 B2
(45) Date of Patent: Dec. 25, 2012

(54) INTERNAL MICROPHONE SUPPORT SYSTEM FOR PERCUSSION INSTRUMENTS

(76) Inventor: Jonathan Mollick, Juneau, AK (US)

( * ) Notice: Subject to any disclaimer, the term of this patent is extended or adjusted under 35 U.S.C. 154(b) by 18 days.

(21) Appl. No.: 13/092,069

(22) Filed: Apr. 21, 2011

(65) Prior Publication Data

US 2011/0259175 A1 Oct. 27, 2011

Related U.S. Application Data

(60) Provisional application No. 61/326,819, filed on Apr. 22, 2010.

(51) Int. Cl.
*G10D 13/02* (2006.01)

(52) U.S. Cl. ..... 84/411 R

(58) Field of Classification Search ..... 84/453, 84/421, 411 R
See application file for complete search history.

(56) References Cited

U.S. PATENT DOCUMENTS 4,168,646 A 9/1979 May
4,242,937 A 1/1981 Pozar
4,570,522 A 2/1986 May
6,121,528 A 9/2000 May
7,256,342 B2 8/2007 Hagiwara
2007/0295189 A1* 12/2007 Kelly ..... 84/421

* cited by examiner

*Primary Examiner* — Kimberly Lockett
(74) *Attorney, Agent, or Firm* — Global Intellectual Property Agency, LLC

(57) ABSTRACT

An internal support device comprising horizontal and vertical straps and a plurality of mounting devices for positioning and isolating acoustic microphones interior to a percussion instrument. The vertical straps are rubber or similar shock absorbing material, arranged in a rectangular pattern and secured at their ends to a percussion instrument shell using a series of isolating lug attachments. Horizontal straps of similar material span opposing vertical straps to form two H-shaped frames for one or a plurality of microphone stand devices. Embodiments of the stand devices include a flat plane attached between the vertical straps, a modified flat plate with an internal wire harness for suspending a microphone, and a flat plane with microphone arm extensions therefrom. An alternate embodiment of the overall device includes a motorized adjustment means and a conveyor means for positioning and refining a microphone position within the drum interior without entering the drum cavity. The disclosed invention provides for modular placement and support for different types of microphones within a percussion instrument, as well as improved microphone isolation for better sound quality in a sound studio or recording environment.

13 Claims, 2 Drawing Sheets

INTERNAL MICROPHONE SUPPORT SYSTEM FOR PERCUSSION INSTRUMENTS

CROSS REFERENCE TO RELATED APPLICATION

This application claims the benefit of U.S. Provisional Application No. 61/326,819 filed on Apr. 22, 2010, entitled "2 "H" Elevation."

BACKGROUND OF THE INVENTION

1. Field of the Invention

The present invention relates to acoustic microphone support devices. More specifically, the present invention pertains to percussion instrument internal microphone stands and isolation means.

2. Description of the Prior Art

Percussion instruments include a family of instruments that produce sounds when struck, shaken or rubbed with a secondary object. The sound is produced by the vibration of instrument and interaction with surrounding air after initial perturbation. Included in this family of instruments are drums, including drum kits that utilize an array of drum designs to create different frequency sounds. The drum types that pertain to the present invention include those with a rigid outer shell and a sufficient internal cavity to place a microphone and support structure for recording purposes. These include bass drums, floor toms or the like.

Capturing sound from these types of percussion instruments can be a difficult task. The nature of the instrument introduces considerable vibration and reverberation that may interfere with the recording process. These effects are interactions with the structure of the drum, the microphone support structure and the microphone itself, which can distort the sound and change its characteristics during recording. Percussionists, audio technicians and engineers have tried several means for recording percussion instruments while eliminating the resonating components during performances and studio sessions, but most share a common drawback of not properly isolating the recording means. Those that incorporate isolation tend to ignore modularity in the support structure, which provides multiple configurations with regard to microphone positioning and the type of microphone being supported. Flexibility of the design is highly desired in live recording sessions, where artists and engineers are striving to create new sounds or record high fidelity audio.

Typically microphones are rigidly mounted within the cavity of a drum or supported in a static configuration that is difficult to change or adapt if an unwanted sound or secondary noise source is disrupting the sound being recorded. Adapting the position of the microphone and its mounting scheme improves the technician's ability to filter out unwanted noise and refine desired sounds, accommodating further creativity of the artist. This is especially true in those performances where an artist may want to produce a unique sound from a percussion instrument, or record one that has improved quality over another. By changing a microphone setup, or by accommodating secondary isolating means, the recorded music may be altered to a different style or tone, or the sound quality may be improved.

Devices have been introduced and disclosed in the art that describe microphone mounting structures and methods. These include devices that can be grouped into two categories: those that employ a rigid mounting scheme and those that include isolation means but lack modularity in regards to microphone location. Both of these are drawbacks in the art in which the present invention remedies. The present disclosure is a new microphone support with all of the advantages of the art without their drawbacks.

Devices in the prior art include U.S. Pat. No. 4,242,937 to Pozar, in which a magnetic pickup assembly is mounted on a support member and extends across the interior of a drum shell. While this device provides support for an internal microphone, the supports are of significant rigidity that drum shell vibration and internal air reverberation may cause the structure and microphone to vibrate or resonate. U.S. Pat. No. 4,570,522 to May is another similar device in which an adjustable microphone mount is disclosed for attachment to the interior shell of a drum. This device is capable of reorienting the attached microphone, however its position is relatively stationary, and its mounting rigidity along the drum shell introduces considerable vibration into the microphone during recording. Similarly, U.S. Pat. No. 6,121,528 to May includes a rigidly designed structure that supports an internal microphone stand. In total, these devices provide little vibration attenuation or isolation for the microphone, which is introduced through its connection means attached to the shell structure of the drum. As the drum head is struck, vibrations are directly transmitted into the microphone support structure. The vibrations may disrupt the desired sounds and enter the recording as static, background noise or a source that blankets the desired sound.

U.S. Published Patent Application No. 2007/0295189 to Kelly is another object in the prior art that describes a bracket to support a microphone internal to a drum, and one is suspended via a plurality of elastomeric cords. The cords provide for a modular mounting location of the bracket within the cavity of the drum. While this device is useful for isolating and locating the microphone in various positions within the drum, it requires several straps and mounting locations along the drum shell for the straps to function. The type of structure suspended by the straps is also limited to one structure and is not capable of supporting several microphone types.

The present invention is an advancement in the art of positioning and isolating microphone within a drum cavity. The present invention comprises a vibration isolating scaffold that supports different microphone types and for varying locations within the drum cavity. Vertically oriented support straps comprising an elastomeric material are situated within the drum and attach to its shell using a series of lugs. The support straps act as stanchions for two horizontally oriented extension straps of similar material, which span the support straps to form two opposing H-frames. The frames provide support for several embodiments of microphone supports, including a flat plane that can be angled and tilted as desired, a hollow flat plane with an internal wire harness for suspending a microphone, and finally arm extensions from a flat plane. The use of elastomeric material for the straps provides damping capability to isolate the microphones, while the design of the frames provides modularity in the microphone support structure. In an alternate embodiment, the support straps are replaced with drive screw mechanisms and electric motors, and the flat plane is replaced with a fore-aft conveyor belt. In this embodiment, the position of the plane and the microphone can be altered without entering the cavity of the drum, and from an external controller. This allows fine tuning of the microphone position for audio technicians and engineers to achieve the desired fidelity within the drum.

SUMMARY OF THE INVENTION

In view of the foregoing disadvantages inherent in the known types of microphone support devices mountable to the interior of a percussion instrument now present in the prior art, the present invention provides a new microphone support device wherein the same can be utilized for providing convenience for the user when supporting and isolating microphones within the cavity of a drum in several configurations and in several locations.

It is therefore an object of the present invention to provide a device comprising two opposing H-frames, wherein vertical straps provide support for opposing horizontal straps. The horizontal straps allow attachment and support of various microphone support devices and microphones thereon.

Another object of the present invention is to provide a device that isolates vibration and reverberation of a microphone within the interior of a drum cavity. The material of the frames provides vibration attenuation and damping, decoupling the attached microphone from the motion of the drum shell.

Another object of the present invention is to provide a device that offers increased modularity with regard to the placement of microphones within the interior of a drum cavity.

Another object of the present invention is to provide several embodiments for the mounting device utilized with the internal frame, including a flat plane, a hollow flat plane with an internal wire harness for suspending a microphone, as well as extension arms from a flat plane.

Lastly, it is an object of the present invention to introduce controllable mechanisms for positioning the microphone within a drum, including shock mounted drive screws, a longitudinal conveyor belt, and associated electric motors to drive the system and fine tune the placement of the microphone without manually changing its position or entering the interior cavity of the drum.

It is also an object of the present invention to provide a new and improved drum-mounted microphone support stand that has all of the advantages of the prior art and none of the disadvantages.

Other objects, features and advantages of the present invention will become apparent from the following detailed description taken in conjunction with the accompanying drawings.

BRIEF DESCRIPTIONS OF THE DRAWINGS

The above invention will be better understood and objects thereof, as well as other objects not stated above, will become more apparent after a study of the following detailed description of the invention and its embodiments. Such description makes use of the annexed drawings wherein.

DETAILED DESCRIPTION OF THE INVENTION

Figure 1:
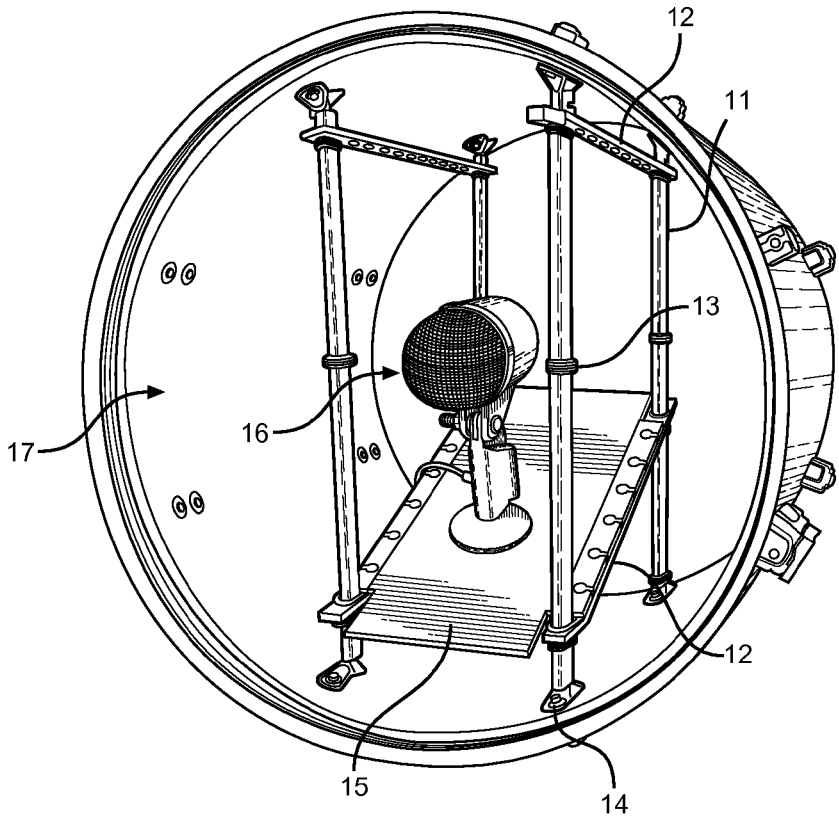
FIG. 1 shows a perspective view of the preferred embodiment of the microphone support stand.

Referring now to FIG. 1, there is shown a perspective view of the preferred embodiment of the present invention. Four support straps 11 are situated within the interior of a drum 17 cavity. The straps 11 terminate at the drum shell interior surface and attach thereto via a drum shell lug 14. Extension straps 12 span two sets of support straps 11 to create opposing H-frames, which support various devices that secure to and position a microphone 16 for sound recording purposes. In the preferred embodiment, a flat plane 15 is provided that spans the internal gap between the four support straps 11 and attaches thereto at its corners. O-ring grommets 13 are provided along the length of the support straps to support the flat plane 15 in a given position and prevent its sliding along the straps 11. The internal friction between the support straps 11 and the extension straps 12 are sufficient to secure its position, but the grommets 13 provide additional support, especially in a vibratory environment.

The flat plane 15 may be moved up and down the lengths of each support strap 11, and angled or tiled as desired to achieve a microphone 16 position that yields the optimal sound quality. The plane 15 is a platform on which a third-party microphone 16 may be affixed or supported. The type of microphone 16 may be any type desired by the user. Its position on the plane 15 may be secured via hook and loop fastening, traditional fastening or bolted joints.

Figure 2:
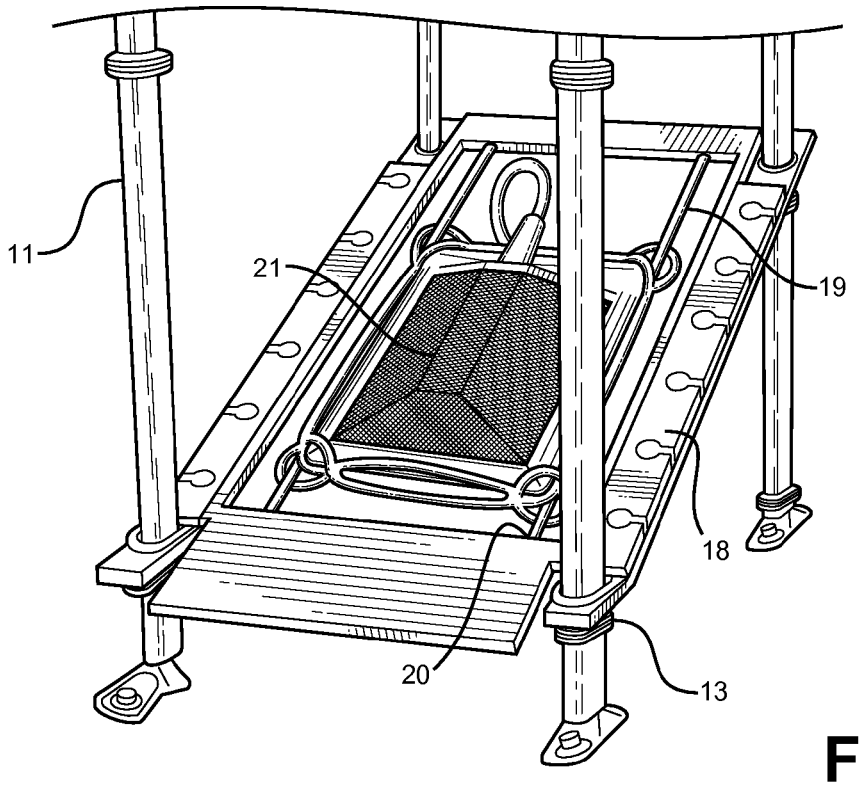
FIG. 2 shows a close-up perspective view of an alternative embodiment of the microphone support device, wherein a microphone is suspended within a hollow flat plane by a wire harness.

Referring now to FIG. 2, there is shown a close-up perspective view of an alternate embodiment of the microphone support device. The elements of the preferred embodiment of the disclosed invention remain the same, wherein four vertically support straps 11 attach to the interior shell of a drum via drum shell lugs 14 at their terminations. Horizontally oriented extension straps span the two sets of support straps 11 to create opposing H-frames for supporting a microphone support device. In this view, a wire harness embodiment of the microphone support device is shown. A flat plane 18 with a hollowed interior is attached to the vertical straps 11 at its four corners, with its interior structure removed to create a rectangular frame for supporting a wire support device. Elastomeric wires 19 affix to both ends of rectangular frame 20 and span its center section, wherein a microphone 21 is suspended. The microphone 21 is surrounded by a wire harness and suspended by a wire 19 support. The wire 19 acts as a suspension device in which the microphone 21 is isolated from the movement of the drum shell and straps 11. The position of the microphone 21 can be moved within the hollow plane 18 by shifting the harness position along the tensioned wire 19.

Figure 3:
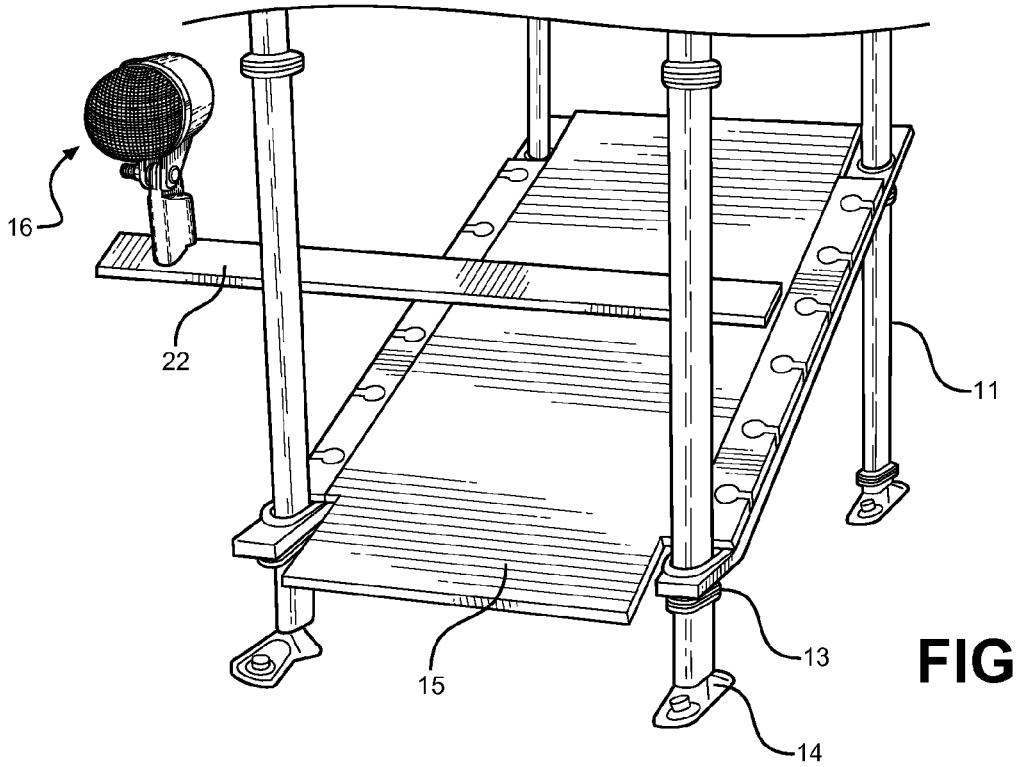
FIG. 3 shows a close-up perspective view of another embodiment of the microphone support device, wherein an extension arm is attached to and projected from a flat plane for supporting a microphone at its working end.

Referring now to FIG. 3, there is shown a close-up perspective view of another embodiment of the microphone support device, in which a flat plane 15 is accompanied by an extension arm 22. The flat plane 15 is the same device as the preferred embodiment of the disclosed invention, wherein its corners are supported by four support straps 11 and two extension straps. O-ring grommets 13 support its positioning along each strap 11 length, while drum shell lugs 14 stabilize the vertical support straps at their terminations. The extension arm 22 provides a stable platform to support a microphone 16 on its end, outside of the flat plane area and closer to the sides of the drum shell. The extension 22 may comprise of an elongated bar member, or it may incorporate several members joined together to position the microphone 16 as desired. The preferred attachment means for the extension arm 22 to the flat plane is hook and loop fastening, however it is not desired to limit this attachment means to only this type. Traditional fastening means and bolted joints are also contemplated for attaching the extension arm 22 to the flat plane 15. As with the preferred embodiment of the invention, the flat plane 15 may be positioned anywhere along the length of each strap 11 and tilted as desired to orient the microphone 16 in different planes.

Figure 4:
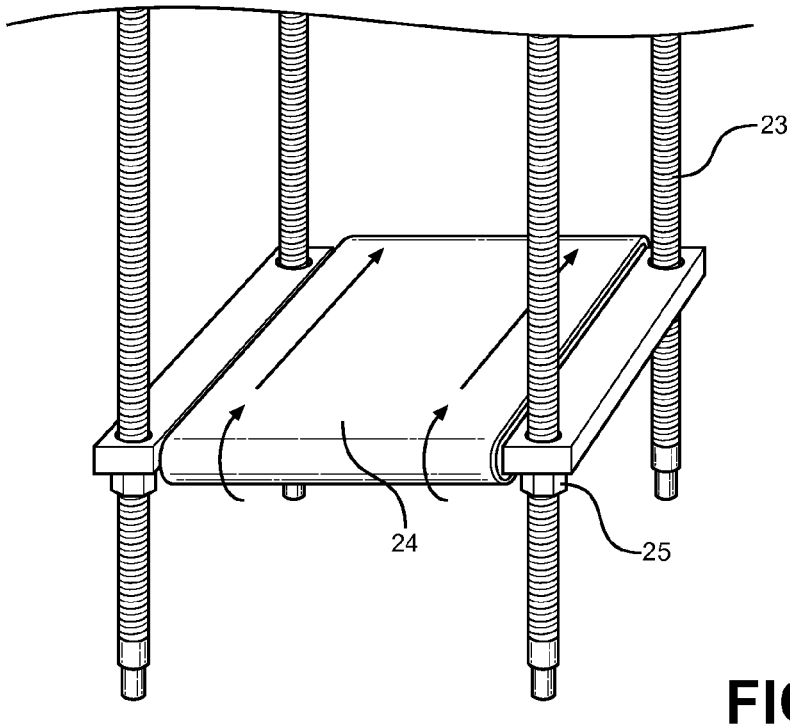
FIG. 4 shows a perspective view of an alternate embodiment of the disclosed invention, wherein the vertical straps are replaced with a drive screw means, and the flat plane is replaced with a fore-aft conveyor belt for externally controlling a microphone position within the drum cavity.

Referring now to FIG. 4, there is shown a close-up perspective view of the alternate embodiment of the disclosed invention, wherein the vertical straps of the device are replaced in favor of drive screws 23, and the flat plane is replace with a fore-aft conveyor belt device 24. In this embodiment, the positioning of a microphone can be controlled externally from the drum interior using a remote control means and electric motor actuation. The drive screws 23 are screw devices that accommodate mating drive nuts at the four corners of the plane 25 supporting the conveyor belt 24. The nuts are driven by independent electric motors, which allow movement of each corner of the device along the drive screws 23. Binding is prevented by internal circuit logic or programming of the electric motor control circuit, wherein the angle of the plane is limited to a certain range, as is capable from the drive nuts and their connection to the drive screws 23. In this way, the plane is elevated and tilted as desired along the screws 23, while a microphone is supported along the length of the conveyor belt device 24. The conveyor 24 allows fore-aft control of the microphone along the plane. In total, the microphone can be positioned without necessitating a user to enter the cavity of a drum and manually adjust its position along the frame device. The user can externally position the microphone, and fine-tune its position while recording. This allows for quick and efficient movement and adjustment during recording sessions and studio sessions for audio technicians.

In use an individual may use the preferred embodiment of the disclosed invention to position a microphone internally within a drum shell for recording purposes. The microphone is adequately isolated from the drum shell vibrations and resonances created therefrom. The drum shell lug attachments fasten directly into the drum shell, while the support straps attach to the lugs at their terminations. The elastomeric material chosen for the straps may be any material type that provides a vibration damping or attenuation property, such as rubber.

The preferred embodiment of the microphone support device includes a flat plane that is supported by the extension straps and can be angled or tilted at various angles. Along the plane, a microphone or a plurality of microphones may be mounted. Additionally, a plurality of planes may be adapted to secure to the vertical straps, allowing several simultaneously mounted planes for supporting several microphones.

The wire harness device of the alternative embodiment of the microphone support device comprises a plurality of elastomeric wire members that stretch between a rectangular frame and suspend a microphone therefrom. Any style of microphone may be chosen, as the wire harness is adaptable to different shapes and can attach anywhere along the length of the rectangular frame.

The alternate embodiment of the disclosed invention is an advancement in microphone placement and control. The actuation and conveyor means provides an audio technician increased control and improved efficiency. The microphone may be moved slightly, or conversely it may be moved drastically from one position to another, in order to achieve a desired recording fidelity.

Additional sound baffling and damping may also be incorporated on the frame device as desired. The straps and associated grommets provide sufficient clearance to support different pillows, sound isolating foam and other baffle means to change the pitch and characteristics of the drum beat sound as it is struck.

Overall the disclosed invention is a considerable improvement in the art for positioning microphones and controlling their placement within a percussion instrument. The device is modular, low cost and easily manufactured. It provides both musicians and audio technicians with a device that can be tweaked and efficiently changed without altering the quality of sound from the instrument. The use of the device in live studio sessions reduces setup time and down time, as the microphone position can be easily adapted to fit needs. The fidelity of the recorded audio is also improved by allowing several degrees of freedom with regard to the microphone position and orientation. The result is a device with a high level of utility, and one that can save considerable time and money for those involved with recording percussion audio.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A microphone placement device within the cavity of a percussion instrument, comprising:

a plurality of support straps attached to a drum shell interior, wherein each of said support straps removably secures to and extends across the interior of a drum cavity, a plurality of extension straps spanning and engaging with at least one set of said support straps, a microphone placement device spanning an interior area between said support straps.

2. A device as in claim 1, wherein said microphone placement device is a flat plane for supporting a microphone on its surface.

3. A device as in claim 2, wherein said flat plane attaches to said support straps at its corners, and is repositionable along said support straps and tilt at different angles with regard to an axis.

4. A device as in claim 1, wherein said microphone placement device is a rectangular frame with an internal wire harness device for suspending a microphone on its surface.

5. A device as in claim 4, wherein said wire harness comprises elastomeric wire material.

6. A device as in claim 1, wherein said microphone placement device is a flat plane with extension arms attaching to said flat plane and extending therefrom.

7. A device as in claim 6, wherein said extension arms attach to said flat plane via hook and loop fastening.

8. A device as in claim 1, wherein said microphone placement device is further supported along said support straps via o-ring grommets.

9. A device as in claim 1, wherein said microphone placement device provides clearance within said drum cavity to include internal sound baffling means, including a pillow or sound baffling foam.

10. An externally controllable microphone placement device within the cavity of a percussion instrument, comprising:

a plurality of vertical drive means engaged to a rectangular frame within a drum shell interior, said rectangular frame have a conveyor belt means, said vertical drive means and conveyor belt means controlled externally from said drum shell interior.

11. A device as in claim 10, wherein said vertical drive means are vertical drive screws engaged with mating drive screw nuts attached at each corner of said rectangular frame.

12. A device as in claim 10, wherein said drive means and conveyor belt means are controlled via electric motors that provide motive power.

13. A device as in claim 10, wherein said drive means is controlled via an electronic control circuit that interprets user input for movement of said drive means and initiates movement, said control circuit prevents movement that binds said drive means.

* * * * *